United States Patent [19]

Forrest

[11] Patent Number: 5,000,259

[45] Date of Patent: Mar. 19, 1991

[54] MOTOR VEHICLE PASSENGER COMPARTMENT HEATER

[75] Inventor: Wayne O. Forrest, Lockport, N.Y.

[73] Assignee: General Motors Corporation, Detroit, Mich.

[21] Appl. No.: 423,929

[22] Filed: Oct. 19, 1989

[51] Int. Cl.[5] ..... F28D 7/06

[52] U.S. Cl. ..... 165/176; 237/12.3 A

[58] Field of Search ..... 165/176, 177, 174, 110, 165/153, 151; 237/12.3 A, 12.3 B

[56] References Cited

U.S. PATENT DOCUMENTS 4,825,941 5/1989 Hoshino et al. ..... 165/176 X

*Primary Examiner*—Henry A. Bennet

*Attorney, Agent, or Firm*—Ronald L. Phillips

[57] ABSTRACT

A motor vehicle passenger compartment heater having a greater number of tubes in the inlet pass than in the outlet pass of the core.

4 Claims, 1 Drawing Sheet

MOTOR VEHICLE PASSENGER COMPARTMENT HEATER

TECHNICAL FIELD

This invention relates to motor vehicle passenger compartment heaters, and more particularly to those of tube and manifold construction wherein a first group of the tubes (inlet tubes) conveys engine coolant from an inlet side of one manifold to the other manifold and a second group of tubes (outlet tubes) conveys the fluid from the latter manifold back to an outlet side of the first mentioned manifold.

BACKGROUND OF THE INVENTION

In motor vehicle passenger compartment heaters of the above type, the current state of the art is to have an equal or nearly equal number of tubes in each group or pass. By doing this, the coolant velocity in all the tubes is nearly identical for what was believed to be best heat transfer performance. However, there can be debris in the coolant system and if this debris lodges in the tube inlets, the entrance velocity into these tubes increases making the heater core more susceptible to erosion.

SUMMARY OF THE INVENTION

In studying the above problem, it was discovered that while some of the inlet tubes may have been plugged up to 75% or more of their total entrance ("plugged" meaning partial to total blockage), the entrances to the outlet tubes were virtually clean in the same cores with the result that the affected inlet tubes suffered from erosion because of increased velocity therein while the outlet tubes did not. Recognizing this, the present invention conceived of manifolding the heater core with the minimum number of outlet tubes required to establish an acceptable velocity therein from the erosion standpoint and with a significantly greater number of inlet tubes than outlet tubes so that in this way the core would be less prone to erosion by inlet tube plugging yet not suffer significant heat transfer performance. Thus the present invention provides for a calculated allowance of inlet tube plugging without increased erosion by initially establishing the inlet tube velocities at a much lower level than normal by simply adding sacrificial inlet tubes to compensate for the increase in flow through the total inlet tube flow area as plugging does occur.

It is thus an object of the present invention to provide a new and improved motor vehicle passenger compartment heater having improved erosion resistance without significant loss in heat transfer performance.

Another object is to provide in a motor vehicle passenger compartment heater a greater number of tubes in the inlet pass than in the outlet pass so that correspondingly the fluid velocity in the individual tubes in the inlet pass is initially significantly less than in the outlet pass and thereby less prone to erosion with increased velocities that result from inlet tube plugging.

Another object is to provide in a motor vehicle passenger compartment heater of tube and manifold construction, an inlet pass having additional sacrificial tubes to decrease the initial fluid flow velocity in the individual tubes of the inlet pass and thereby render the core less susceptible to erosion by inlet tube plugging.

These and other objects of the present invention will become more apparent from the following description and drawing in which:

DETAILED DESCRIPTION OF INVENTION

Figure 1:
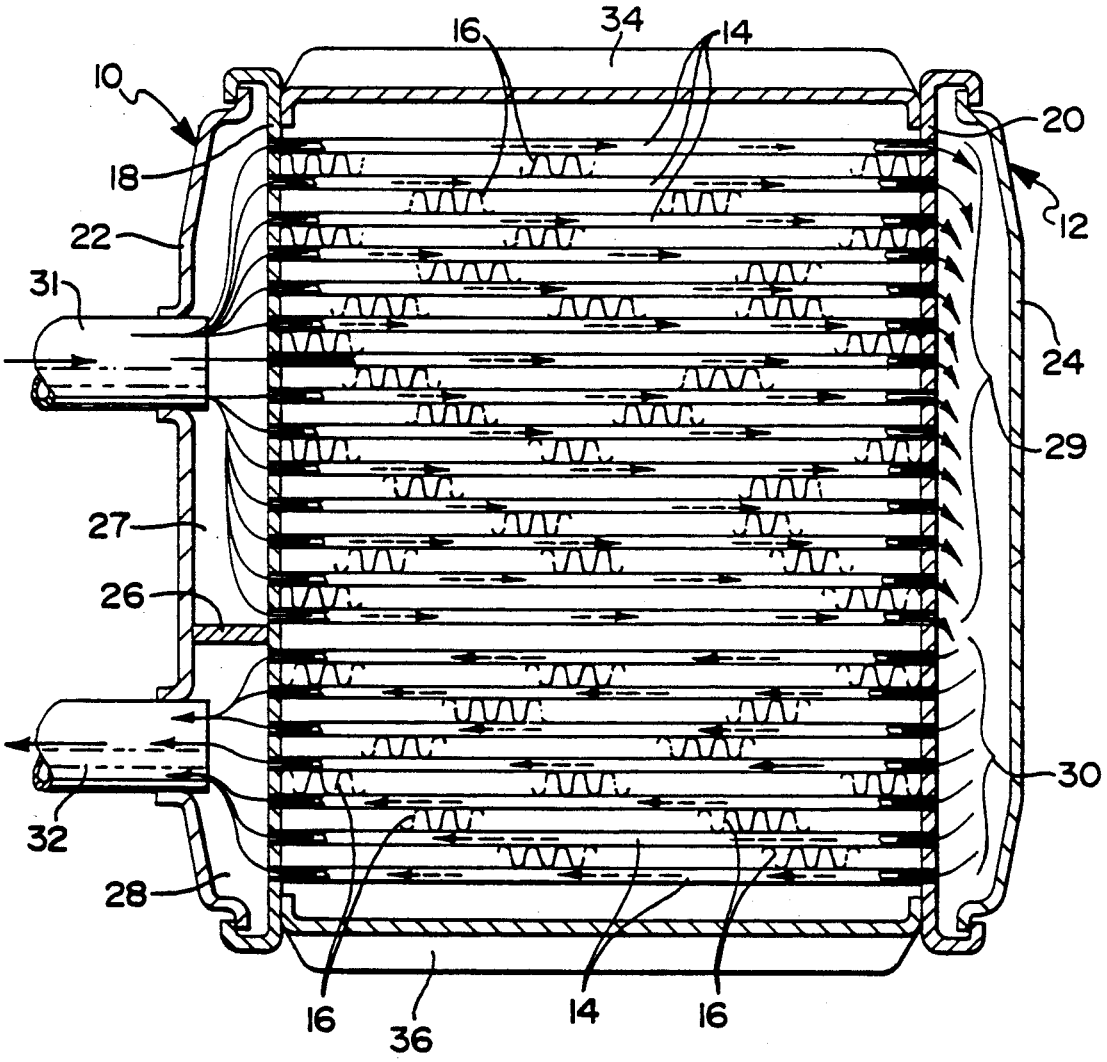
FIG. 1 is a front view with parts broken away of an automotive car heater constructed according to the present invention.

Referring to FIG. 1, there is shown an automotive passenger compartment heater comprising an inlet/outlet manifold 10, a return manifold 12, a plurality of flat sided identical tubes 14 connected at their opposite ends to the respective manifolds, and a plurality of corrugated fins or air centers 16 individually sandwiched between adjacent tubes. The manifolds 10 and 12 are of tank type construction comprising a header plate 18 and 20 to which the tubes are directly joined, and a concave shell 22 and 24 which cooperates with the respective header plate to form the manifold or tank. The inlet/-outlet manifold 10 is divided internally by a partition 26 into an inlet chamber 27 and an outlet chamber 28 which are respectively open to selected groups 29 and 30 of the tubes. The inlet chamber 27 is also open to an inlet fitting 31 that is attached in an opening in the shell 22 and connected to receive coolant from an engine coolant system (not shown). Similarly, the outlet chamber 28 is open to an outlet fitting 32 that is joined to the shell 22 but on the opposite side of the partition 26 and connected to return the coolant to the engine coolant system. In addition, there are provided reinforcement side members 34 and 36 on opposite sides of the sandwiched tubes and fins which extend to the respective manifolds and together with the manifolds and the other core parts are all brazed together in their properly assembled position as shown. In the resulting integral structure, the tube group 29 forms an inlet pass that conveys engine coolant from the inlet chamber 27 to the return manifold 12 while the other tube group 30 forms an outlet pass that conveys the coolant from the return manifold to the outlet chamber 28 of the inlet/outlet manifold.

According to the present invention, the inlet/outlet manifold 10 and return manifold 12 are connected with the tubes so there is only the minimum number of outlet tubes 30 required to establish an acceptable velocity therein from the erosion standpoint (i.e., no allowance for plugging) and a substantially greater number of inlet tubes 29 as a sacrifice to anticipated plugging. This is simply accomplished by positioning of the partition 26 so that the desired larger group of tubes is open to the inlet chamber 27 than to the outlet chamber 28. In the embodiment shown which has been released for production, there is a total of twenty-one (21) tubes with twice the number of tubes connected in the inlet pass than in the outlet pass, i.e. fourteen (14) of the tubes connected in the inlet pass 29 and only the remaining seven (7) tubes connected in the outlet pass 30. As a result, the fluid velocity in the individual tubes in the inlet pass is half that of the tubes in the outlet pass where initially installed in a motor vehicle and there is in effect a seven (7) tube sacrificial offering.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, while a ratio of 2:1 between the number of inlet tubes and outlet tubes is disclosed, this ratio may be higher or lower based on plugging projection studies for the intended end use. The embodiment was thus chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. In a motor vehicle passenger compartment heater having first manifold means with an inlet fitting and an outlet fitting, second manifold means, a plurality of tubes connected at opposite ends to said two manifold means, said first manifold means being divided into an inlet chamber and an outlet chamber, said inlet chamber being open to said inlet fitting and a first selected group of said tubes, and said outlet chamber being open to said outlet fitting and a second selected group of said tubes whereby fluid received in said inlet chamber from said inlet fitting flows through said one group of tubes to said second manifold means and then via said second manifold means to said second group of tubes and on to said outlet chamber and said outlet fitting: the improvement comprising said second group having only the minimum number of tubes required to establish an acceptable velocity therein from an erosion standpoint, and said first group having a substantially greater number of tubes than said second group whereby the fluid velocity in the individual tubes in said first group is substantially less than that in the tubes of said second group to compensate solely for plugging of the tubes in said first group by foreign material.

2. In a motor vehicle passenger compartment heating having first manifold means with an inlet fitting and an outlet fitting, second manifold means, a plurality of tubes connected at opposite ends to said two manifold means, said first manifold means being divided, into an inlet chamber and an outlet chamber, said inlet chamber being open to said inlet fitting and a first selected group of said tubes, and said outlet chamber being open to said outlet fitting and a second selected group of said tubes whereby fluid received in said inlet chamber from said inlet fitting flows through said one group of tubes to said second manifold means and then via said second manifold means to said second group of tubes and on to said outlet chamber and said outlet fitting: the improvement comprising said second group having only the minimum number of tubes required to establish an acceptable velocity therein from an erosion standpoint, and said first group having about twice the number of tubes as said second group whereby the fluid velocity in the individual tubes in said first group is about half that in the tubes of said second group to compensate solely for plugging of the tubes in said first group by foreign material.

3. In a motor vehicle passenger compartment heater having an inlet/outlet tank with an inlet fitting and an outlet fitting, return means, a plurality of tubes connected at opposite ends to said tank and return means, and a partition in said inlet/outlet tank that divides same into an inlet chamber and an outlet chamber, said inlet chamber being open to said inlet fitting and a first selected group of said tubes, and said outlet chamber being open to said outlet fitting and a second selected group of said tubes whereby said partition forces fluid received in said inlet chamber to flow through said one group of tubes to said return means and then via said return means to said second group of tubes and on to said outlet chamber: the improvement comprising said partition being arranged so that said second group has only the minimum number of tubes required to establish an acceptable velocity therein from an erosion standpoint and said first group has a substantially greater number of tubes than said second group whereby the fluid velocity in the individual tubes in said first group is substantially less than that in the tubes of said second group to compensate solely for plugging of the tubes in said first group by foreign material.

4. In a motor vehicle passenger compartment heater having an inlet/outlet tank with an inlet fitting and an outlet fitting, return means, a plurality of tubes connected at opposite ends to said tank and return means, and a partition in said inlet/outlet tank that divides same into an inlet chamber and an outlet chamber, said inlet chamber being open to said inlet fitting and a first selected group of said tubes, and said outlet chamber being open to said outlet fitting and a second selected group of said tubes whereby said partition forces fluid received in said inlet chamber to flow through said one group of tubes to said return means and then via said return means to said second group of tubes and on to said outlet chamber: the improvement comprising said return means being a singular tank and said partition being arranged so that said second group has only the minimum number of tubes required to establish an acceptable velocity therein from an erosion standpoint and said first group has about twice the number of tubes as said second group whereby the fluid velocity in the individual tubes in said first group is about half that in the tubes of said second group to compensate solely for plugging of the tubes in said first group by foreign material.

* * * * *